US007315707B2

(12) United States Patent
Nishitani et al.

(10) Patent No.: US 7,315,707 B2
(45) Date of Patent: Jan. 1, 2008

(54) IMAGE FORMING APPARATUS WITH MOVABLE PLACEMENT MEMBERS

(75) Inventors: Hitoshi Nishitani, Tokyo (JP); Atsushi Munakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/004,914

(22) Filed: Dec. 7, 2004

(65) Prior Publication Data

US 2005/0123318 A1 Jun. 9, 2005

(30) Foreign Application Priority Data

Dec. 9, 2003 (JP) ..... 2003-410200

(51) Int. Cl.
*G03G 15/00* (2006.01)

(52) U.S. Cl. ..... 399/107

(58) Field of Classification Search ..... 399/107, 399/108; 248/637, 677, 678; 312/351.1, 312/351.3, 351.4, 351.5, 351.7
See application file for complete search history.

(56) References Cited

U.S. PATENT DOCUMENTS 6,837,339 B2 * 1/2005 Lees ..... 182/200
2003/0193000 A1 * 10/2003 Leveridge ..... 248/188.2
2003/0230681 A1 * 12/2003 Gwynneth ..... 248/188.3

FOREIGN PATENT DOCUMENTS

JP 10186071 A * 7/1998
JP 10186762 A * 7/1998
JP 2000-330351 11/2000
JP 2002023440 A * 1/2002
JP 2002264432 A * 9/2002
JP 2003316096 A * 11/2003

OTHER PUBLICATIONS

Machine Translation from JPO website of JP 2000-330351A.*

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

The image forming apparatus includes a first placement member, a second placement member, a third placement member and a fourth placement member, which contact with a placement surface on which the image forming apparatus is placed, and which support the image forming apparatus, a side plate of the image forming apparatus, and a supporting section for supporting the image forming apparatus. The supporting section is supported by the third placement member and the fourth placement member, which are movable in a vertical direction of the image forming apparatus. This can prevent the deformation of the image forming apparatus without increasing the load on a bottom plate.

8 Claims, 7 Drawing Sheets

6
1
2
D
E
5
5a
3
4
3,4
11
12
13
14
15
16
17
18
19

IMAGE FORMING APPARATUS WITH MOVABLE PLACEMENT MEMBERS

BACKGROUND OF THE INVENTION

1. Field of the invention

The present invention relates to a placement structure for a monochromatic image forming apparatus or a full-color image forming apparatus employing electrophotography.

2. Related Background Art

In the field of image forming apparatuses employing electrophotography such as full-color printers, a smaller-sized printer with a lower price and higher image quality is required by the market, in particular, as more and more personal computers are being generally used.

FIGS. 5A and 5B are schematic section diagrams of an indirect-transfer-type, full color image forming apparatus that employs electrophotography.

In FIGS. 5A and 5B, reference numeral 11 denotes paper feeding means for separating stacked paper sheets and feeding them; reference numeral 12 denotes a registration roller for detecting the leading edge of a paper sheet and conveying the paper sheet in synchronization with an image signal; reference numeral 13 denotes a transfer belt for forming an intermediate image; reference numeral 14 denotes a developing device having four photosensitive drums 19; reference numeral 15 denotes exposure means for forming a latent image on each photosensitive drum 19; reference numeral 16 denotes first-transfer means for transferring a toner image onto the transfer belt 13 by reverse biasing; reference numeral 17 denotes second-transfer means for transferring the toner image from the transfer belt 13 onto a paper sheet by reverse biasing; and reference numeral 18 denotes a fixing device for fixing the toner as a permanent image on the paper sheet by heating and pressing.

In the indirect-transfer-type, full-color image forming apparatus having such an arrangement, a latent image on each photosensitive drum 19 is visualized as a toner image on the developing device 14; the toner image is first-transferred on the transfer belt 13, and the toner image is then second-transferred onto a paper sheet by reverse biasing from the backside of the paper sheet, thereby forming a desired full-color image.

A function unit, which is constituted of the above described paper feeding means 11, registration roller 12, transfer belt 13, developing device 14, exposure means 15, first-transfer means, second transfer means 17, and fixing device 18, is fixed to a main frame 6. The main frame 6 is then supported by four placement legs 21 (only two of them shown) provided at front and rear, left and right positions.

A tandem-type, multicolor image forming apparatus, which has a plurality of photosensitive drums 19 arranged in line, may be an image forming apparatus of lateral arrangement in which a plurality of photosensitive drums 19 are arranged horizontally as shown in FIG. 5A, or an image forming apparatus of vertical arrangement in which a plurality of photosensitive drums 19 are arranged vertically as shown in FIG. 5B. An image forming apparatus having a lateral arrangement shown in FIG. 5A has a smaller height, but is difficult in replacement of consumables in the developing device 14 or the like. On the other hand, an image forming apparatus having a vertical arrangement, as shown in FIG. 5B, allows easy replacement of consumables but has a greater height.

Such a tandem-type multicolor image forming apparatus requires high positional accuracy between photosensitive drums that form respective colors. However, when the multicolor image forming apparatus is placed on an uneven surface, for example, on an area where it is placed with four placement points with only one point being different in a height level than the other points, the following problem arises. Since the straight line connecting a point and another point of different height levels and the straight line connecting the two other points are not parallel with each other, a force results that deforms the main body of the image forming apparatus. The occurrence of deformation of the main body of the image forming apparatus changes the positional relationship between the photosensitive drums and scanner as the exposure means for each color, depending on the strength of the bottom plate of the main body of the image forming apparatus, leading to misregistration in images.

Accordingly, in the case where tension is given to an endless belt to move according to the frame of the main body of the image forming apparatus, the deformation of the frame of the main body of the image forming apparatus may increase the displacement force on the endless belt. As a result, the increase in the displacement force on the endless belt may cause the deterioration or breakage of an end portion of the belt, affecting the life of the endless belt. The endless belt may be, for example, an electrostatic transfer belt that contacts with a plurality of photosensitive drums as image bearing members and conveys transfer material attracted electrostatically thereon to a fixing device consisting of a fixing roller and a pressing roller, or an intermediate transfer belt that contacts with a plurality of image bearing members, sequentially transfers and overlays images onto the belt, and transfers all images on the belt onto the transfer material at a time.

Therefore, there are methods for preventing the above problems by reducing the deformation of the main frame, as follows. A first method is to substantially increase the rigidity of the main frame so that the main frame cannot be deformed even when the main body of the image forming apparatus is placed on the surface mentioned above. A second method is to substantially increase the rigidity of the bottom plate against deformation so that the unevenness of the placement surface cannot cause the main frame to be deformed. A third method is to use only three placement points (Japanese Patent Application Laid-Open No. 2000-330351). In the case where only three placement points are used, a plane is defined by the three points, and therefore the main frame is not deformed even when the main body of the image forming apparatus is placed on an uneven surface.

In the first and second methods, to increase the rigidity of components of the main frame or the bottom plate against deformation, the thickness of the bottom plate may be increased or the section area thereof may be increased with a drawing shape or the like. This results in the heavy weight of the main body and the increased cost for parts. Further, the use of a drawing shape for improving the rigidity may badly affect the flatness and the dimension accuracy, resulting in the lowered accuracy in mounted position of the photosensitive drums or scanner. Therefore, this presents a significant problem in developing a smaller-sized printer with a lower price and higher quality image, for which the market has a strong demand.

Regarding the reduction of the deformation of the main frame, the most advantageous method for providing a smaller-sized printer with a lower price and higher quality image is the above-mentioned, third method that uses only three placement points, but the method has a significant problem as described below.

FIGS. 7A and 7B shows side section diagrams of a typical arrangement of an image forming apparatus in which a paper feeding cassette 22 for stacking recording paper sheets is provided at the bottom thereof; an image forming section is provided above the paper feeding cassette 22; a paper discharge tray 23 is provided at the top thereof; and a recording paper sheet is conveyed in the direction of the arrow so that operations including paper feeding, image formation and paper discharge are performed. Here, the shown dimension X, which may be a depth or width of the product, is designed to be as small as possible to provide a smaller-sized image forming apparatus.

To achieve such a smaller-sized printer for which the market has a strong demand, it is a common practice that recording paper sheets of A4, B5 or letter size, which are more frequently used as transfer material, are accommodated in a size within the shown dimension X as shown in FIG. 7A, while larger-sized paper sheets such as those of A3 or legal-size, which are less frequently used as transfer material, are accommodated in the paper feeding cassette 22 that has a larger size than the shown dimension X, as shown in FIG. 7B. Thus, when using a recording paper of (or smaller than) A4, B5 or letter size, which are frequently used, the placement area can be within the shown dimension X, thereby allowing effective use of space. When the placement area is increased by the shown dimension Y, larger-sized recording paper can be used. Therefore, such a type of arrangement in which larger-sized recording paper is used while exceeding the normal placement area is very advantageous for users.

In order to achieve both the arrangements: the arrangement in which only three placement points as described above is defined to reduce the deformation of the main frame, and the arrangement of the type in which larger-sized recording paper is used while exceeding the normal placement area, it is required that three placement points A, B and C are defined symmetrically with respect to the center of image, and in particular the placement point C is defined under the paper feeding cassette 22 as shown FIG. 8A, or that three placement points A', B' and C' are defined non-symmetrically with respect to the center of image as shown in FIG. 8B.

However, even if the placement point C is provided under the paper feeding cassette 22 as shown in FIG. 8A, using only the space under the paper feeding cassette 22 is not enough since substantial rigidity along edge line a is required for supporting the body. Therefore, to secure the rigidity along edge line a, an expensive member having large section area must be applied to increase the rigidity of the bottom plate. Moreover, expanding the space under the cassette 22 interferes with the object of using the arrangement with only three placement points to provide a smaller-sized, lower-price apparatus.

When using the arrangement in which the main frame is non-symmetrically supported as shown in FIG. 8B, placement legs cannot be provided on the front side of the apparatus, which is a side for taking out the paper feeding cassette 22. The front side of the apparatus can be subject to a load from a user who accesses the operation section or replaces consumables. This causes the non-symmetrical deformation of the main frame, which directly leads to misregistration, the increase in displacement force on the endless belt, and inclined conveyance of recording paper. Therefore, this arrangement is not feasible.

Furthermore, in the three-placement point case, each point bears a heavier load, and, thus, the bottom place must be reinforced more than otherwise required.

SUMMARY OF THE INVENTION

An object of the present invention is to prevent the deformation of an image forming apparatus when placed on an uneven surface, without increasing the load on its bottom plate.

This and other objects can be achieved by an image forming apparatus comprising a first placement member and a second placement member fixed to a body of the image forming apparatus for supporting the image forming apparatus while contacting with a placement surface when the image forming apparatus is placed thereon. A side plate is disposed on a side face of the image forming apparatus. A third placement member and a fourth placement member are provided for supporting the image forming apparatus, while contacting with the placement surface when the image forming apparatus is placed thereon. Supporting means are disposed on the side plate, for supporting the third placement member and the fourth placement member movably in a vertical direction of the image forming apparatus.

Other objects of the present invention will be understood when reading the following description.

DETAILED DESCRIPTION OF THE PREFERRED EMBODIMENTS

Embodiments of the present invention will be described with reference to the appended drawings.

Figures 1A, 1B, 1C:
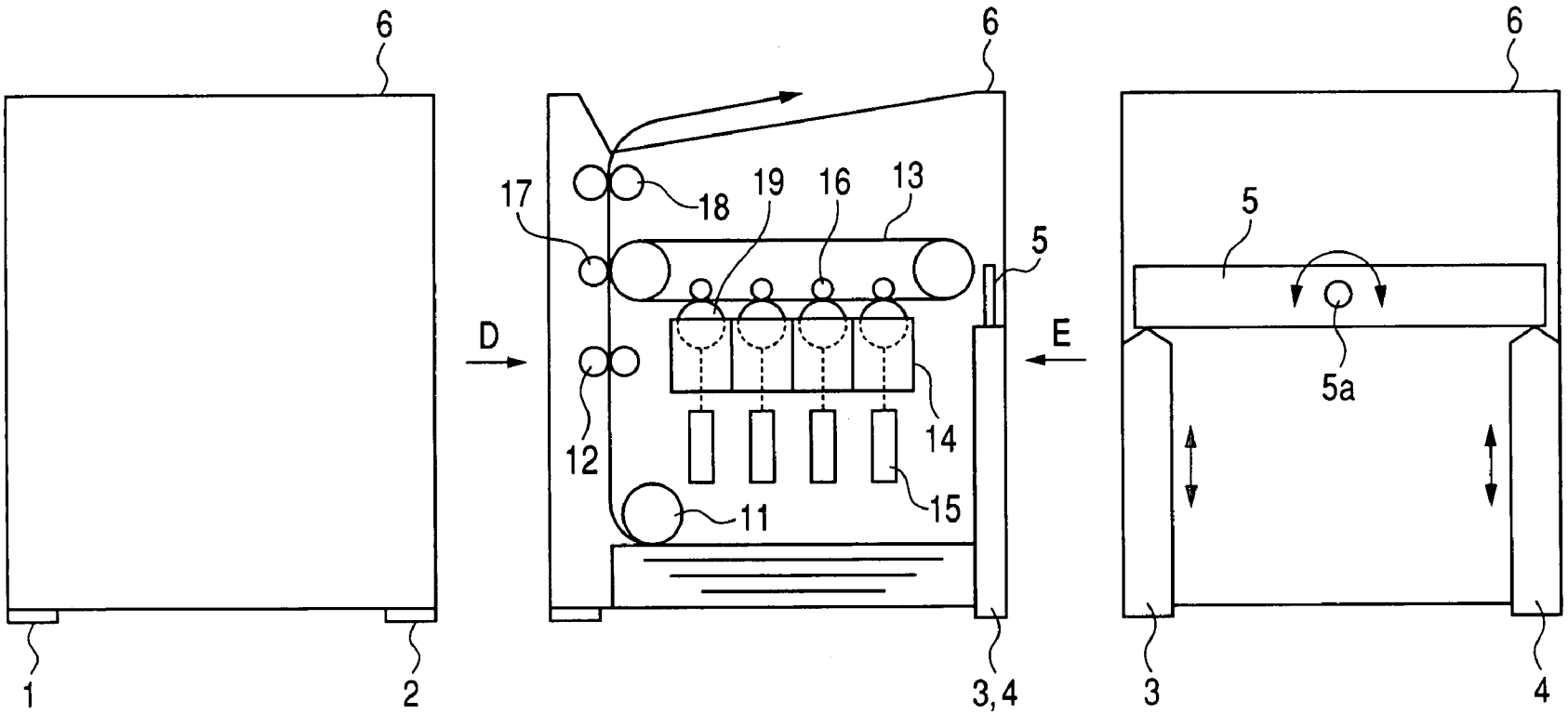
FIGS. 1A, 1B and 1C show schematic section diagrams of an image forming apparatus according to the present invention.

FIGS. 1A to 1C show an indirect-transfer-type, full-color image forming apparatus employing electrophotography. FIG. 1A is a diagram when viewing FIG. 1B in the direction of arrow D. FIG. 1B is a schematic section diagram. FIG. 1C is a diagram when viewing FIG. 1B in the direction of arrow E.

In FIGS. 1A, 1B and 1C, reference numeral 11 denotes paper feeding means for separating stacked paper sheets and feeding them; reference numeral 12 denotes a registration roller for detecting the leading edge of a paper sheet and conveying the paper sheet in synchronization with an image signal; reference numeral 13 denotes a transfer belt for forming an intermediate image as an intermediate transfer member; reference numeral 14 denotes a developing device as developing means having four photosensitive drums 19 as image bearing members arranged substantially in horizontal direction, which forms a toner image on the image bearing members; reference numeral 15 denotes four exposure means for forming a latent image on each photosensitive drum 19; reference numeral 16 denotes first-transfer means for transferring a toner image onto the transfer belt 13 by reverse biasing; reference numeral 17 denotes second-transfer means for transferring the toner image from the transfer belt 13 onto a paper sheet by reverse biasing; and reference numeral 18 denotes a fixing device as fixing means for fixing the toner on the paper sheet by heating and pressing.

In such an indirect-transfer-type, full-color image forming apparatus, a latent image on the photosensitive drum 19 is visualized as a toner image on the developing device 14. The the toner image is first-transferred on the transfer belt 13, and the toner image is then second-transferred onto a paper sheet by reverse biasing from the backside of the paper sheet, thereby forming a desired full-color image.

A function unit, which is constituted of the above described paper feeding means 11, registration roller 12, transfer belt 13, developing device 14, exposure means 15, first-transfer means 16, second transfer means 17, and fixing device 18, is fixed to the frame 6 of the main body. The frame 6 of the main body is then supported by flat, first and second placement legs 1 and 2 (as first and second placement members) provided at left and right positions in the front lower portion, and third and fourth placement legs 3 and 4 (as third and fourth placement members) provided at left and right positions in the rear portion. Here, the third and fourth placement legs 3 and 4 are disposed movably in upward and downward directions, and one end of each leg (top end) is formed in a mountain-like shape as shown.

On the backside of the main frame 6, a pivoting member 5 formed in a plate shape, elongated in a lateral direction, is pivotably supported by a pivot 5*a* at the center thereof in the width direction. The pivoting member 5 is supported at left and right positions thereof by the tips of the mountain shapes of the third and fourth legs.

Figure 2:
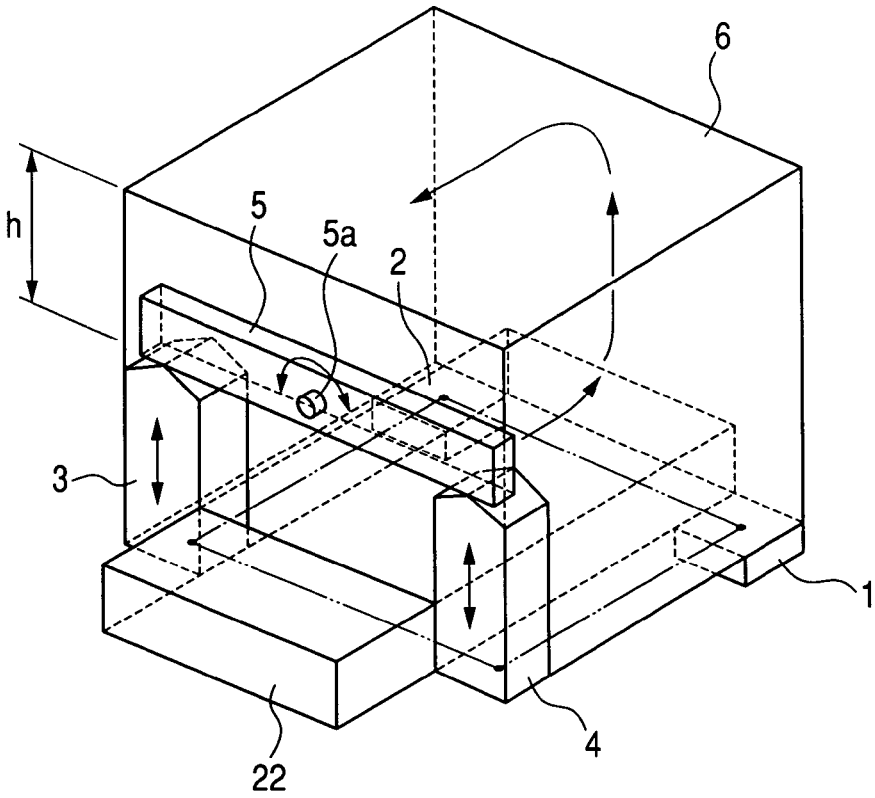
FIG. 2 is a perspective diagram of an image forming apparatus according to the present invention.

FIG. 2 is a perspective diagram when viewing the image forming apparatus from the rear side.

In FIG. 2, reference numerals 1 and 2 denote the first and second placement legs; reference numerals 3 and 4 denotes the third and fourth placement legs; reference numeral 5 denotes the pivoting member; reference numeral 5*a* denotes the pivot of the pivoting member 5 (the center of pivoting); and reference numeral 6 denotes the frame of the main body of the image forming apparatus. The exposure means and transfer means supported by the frame 6 of the main body are not shown. The pivot 5*a* is arranged at the side plate of the image forming apparatus to rotatably support the pivoting member 5. The third placement member 3 and fourth placement member 4 are supported by the pivoting member 5. The side of the image forming apparatus is constituted of the side plates.

As shown in FIG. 2, the first and second placement legs 1 and 2 directly support the frame 6 of the main body on the placement surface, while the third and fourth placement legs 3 and 4 support the frame 6 of the main body on the placement surface, by means of the pivoting member 5.

Here, the third and fourth placement legs 3 and 4 are mounted to the main frame 6 with the legs movable rectilinearly in the direction of the shown arrow (upward and downward directions), and with the lower ends of the legs contacting with the placement surface and the upper ends of the legs contacting with the pivoting member 5 to be freely separated from the pivoting member 5. The pivoting member 5 is mounted to the main frame 6 to be pivotable about the pivot 5*a* in the direction of shown arrow.

Figure 3:
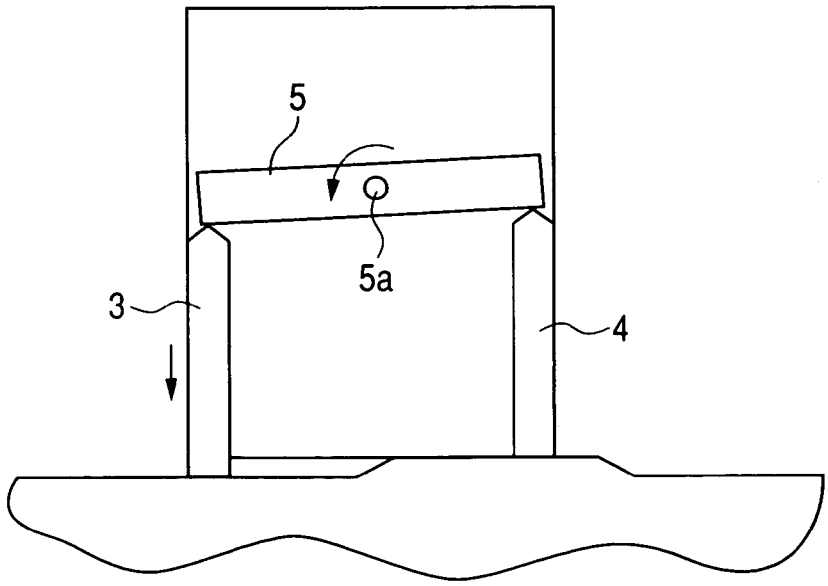
FIG. 3 is an illustrative diagram for showing an advantage of an image forming apparatus according to the present invention.

When the image forming apparatus is placed on an uneven placement surface, as shown in FIG. 3, with the frame 6 of the main body supported by the pivoting member 5 on the placement surface as described above, the third placement leg 3 moves downward causing the pivoting member 5 to pivot in the direction of the arrow about the pivot 5*a* (counter-clockwise). In this situation, while the third and fourth placement legs 3 and 4 and the pivoting member 5 are balanced at respective positions that are non-symmetrical, the frame 6 of the main body is supported substantially at three points of the first and second legs 1 and 2 and the pivot 5*a*, thereby minimizing the deformation of the main frame 6 due to its own weight.

Figure 8A:
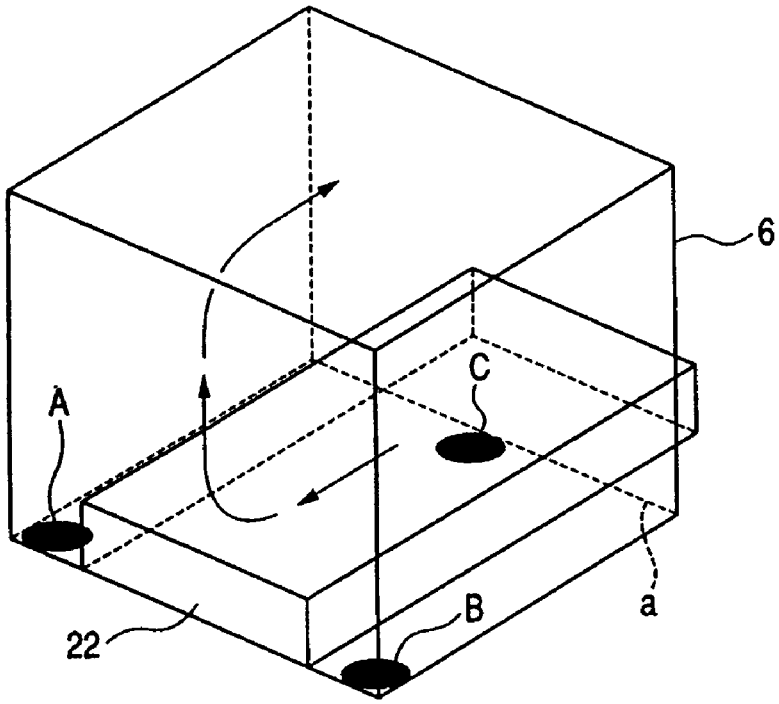
FIG. 8A PRIOR ART
FIGS. 8A and 8B show illustrative diagrams of a conventional image forming apparatus.
Figure 8B:
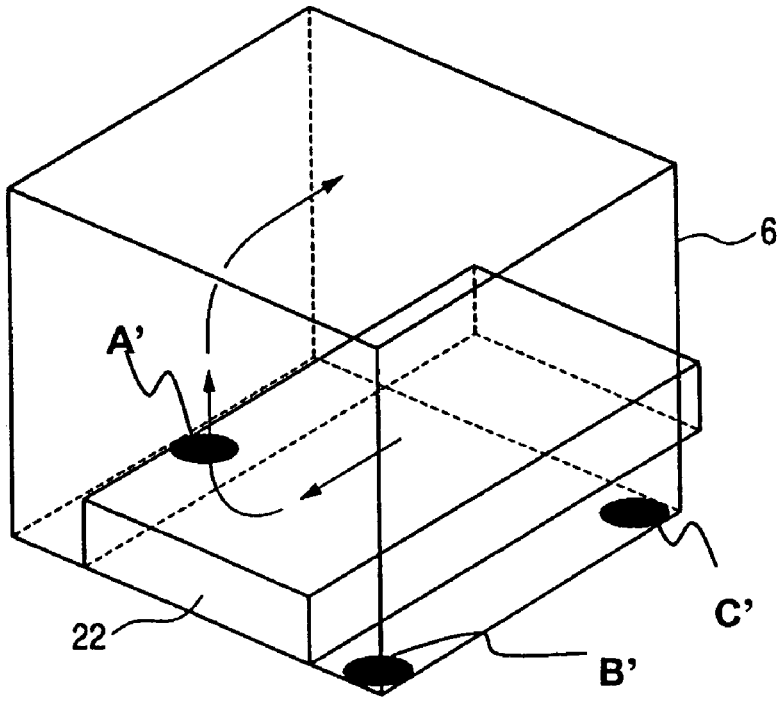
FIG. 8B PRIOR ART

Here, the mechanism in which the body is supported at three points positioned substantially symmetrically with respect to the center of the image is similar to the example of conventional art shown in FIG. 8A. However, supporting the body at a point under the paper feeding cassette 22 (shown point C), as shown in FIG. 8A, requires that the rigidity along the edge line shown by "a" be substantially high. However, using only the space under the paper feeding cassette 22, the rigidity cannot be achieved, as described above.

On the other hand, in the case where the pivot 5*a* is provided at a high level as shown in FIG. 2, it is possible to secure a substantial dimension h shown in FIG. 2 for the pivot 5*a* for supporting pivoting member 5, thereby easily giving the frame 6 of the main body required substantial flexural rigidity.

The paper feeding cassette 22 is provided so that paper sheets are placed substantially horizontally. Thus, when viewing paper sheets of the maximum size stacked in the paper feeding cassette 22 from the vertically upper side, a portion of the paper feeding cassette 22 or the stacked paper sheets is projecting from the tetragon defined by connecting the centers of the first, second, third and fourth placement legs 1, 2, 3 and 4 (see FIG. 2).

Figure 4A:
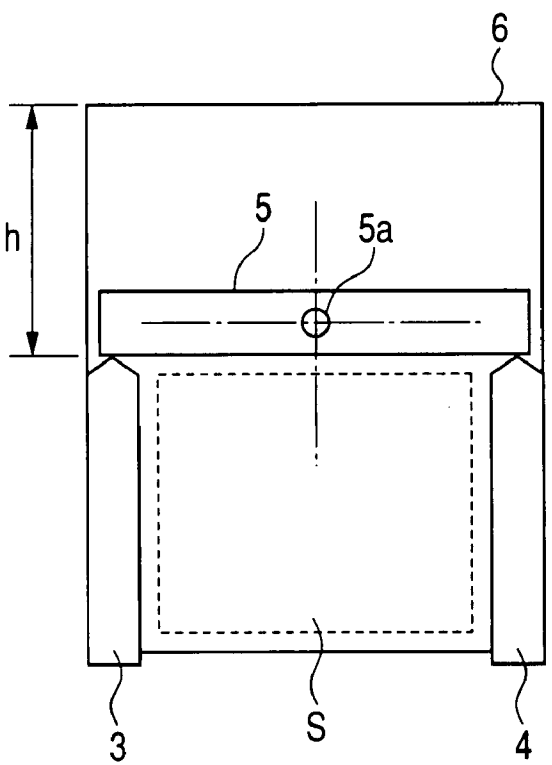
FIGS. 4A, 4B and 4C show illustrative diagrams for showing an advantage of an image forming apparatus according to the present invention.
Figure 4B:
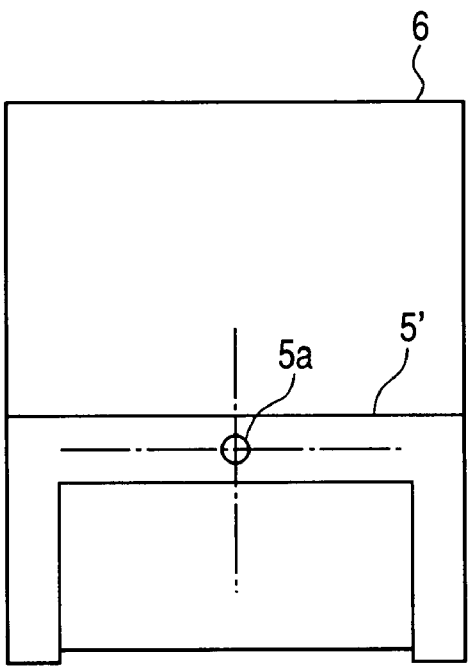
Figure 4C:
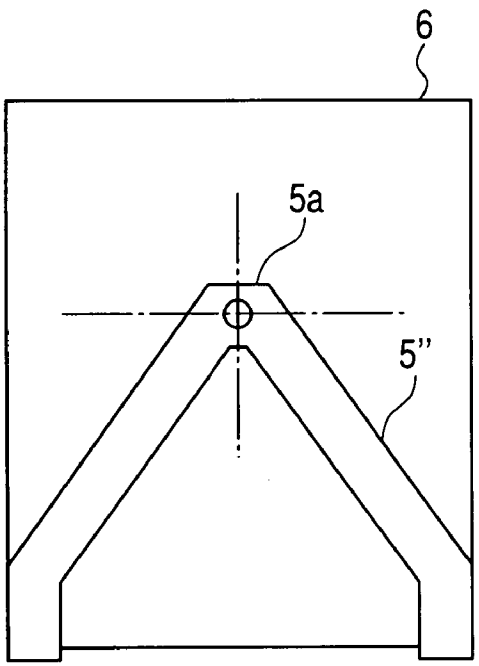
Figure 5B:
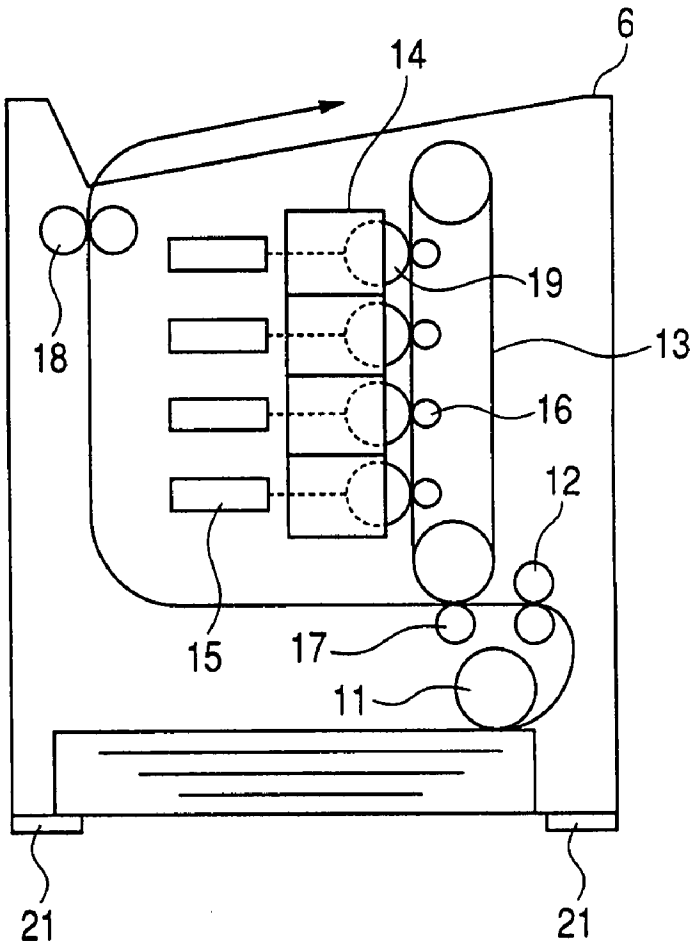
FIG. 5B PRIOR ART
FIGS. 5A and 5B show schematic section diagrams of a conventional image forming apparatus.
Figure 5A:
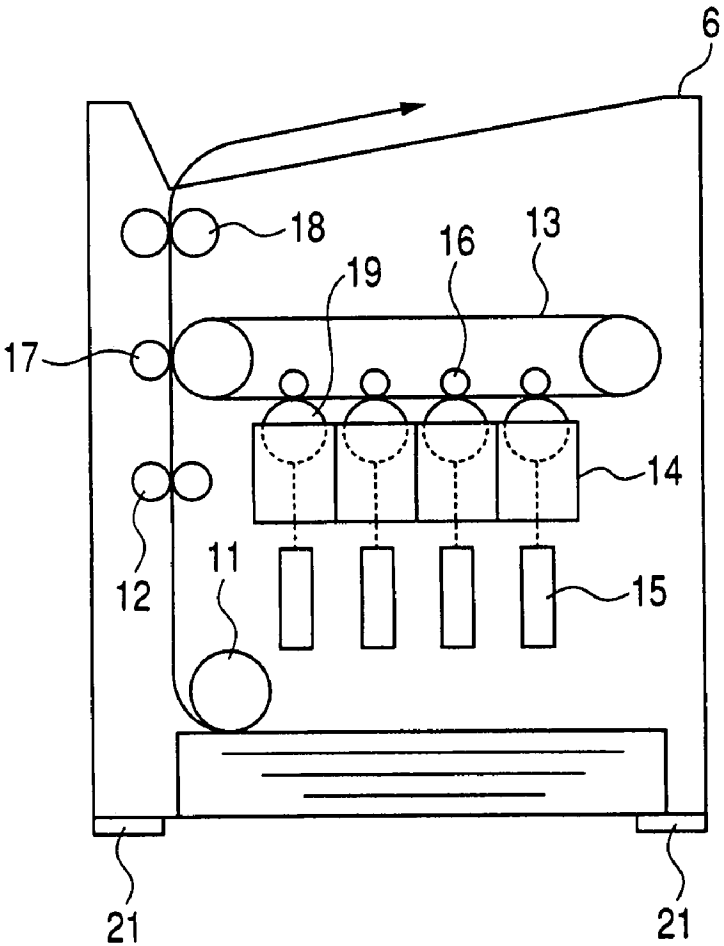
FIG. 5A PRIOR ART
Figure 6:
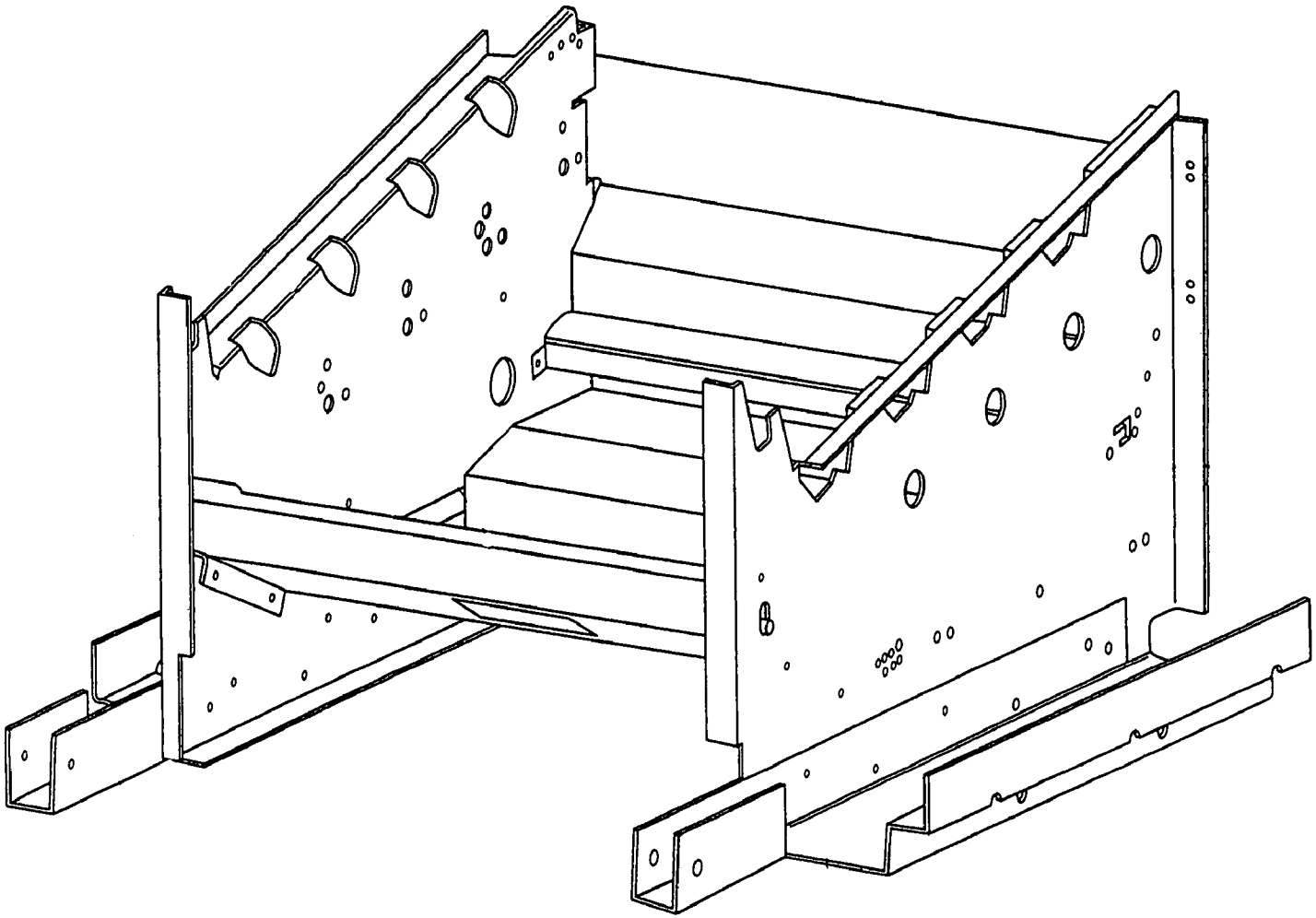
FIG. 6 PRIOR ART
FIG. 6 is a diagram of an actual image forming apparatus.
Figure 7A:
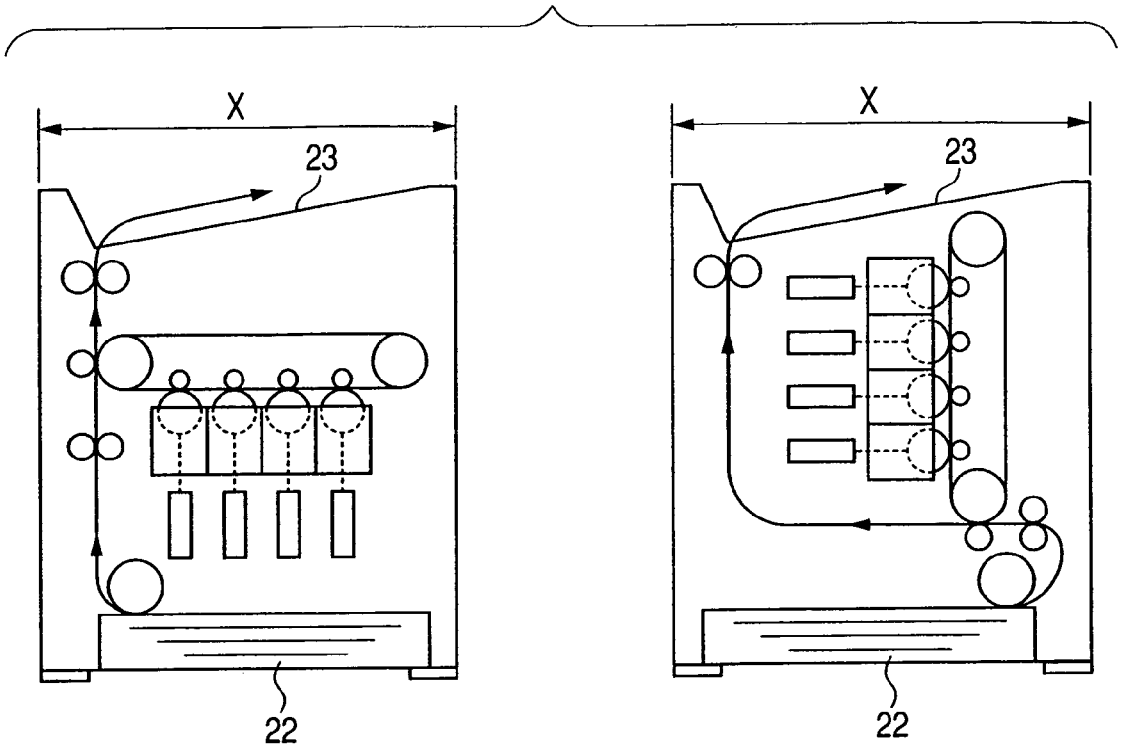
FIG. 7A PRIOR ART
FIGS. 7A and 7B show illustrative diagrams of a conventional image forming apparatus.
Figure 7B:
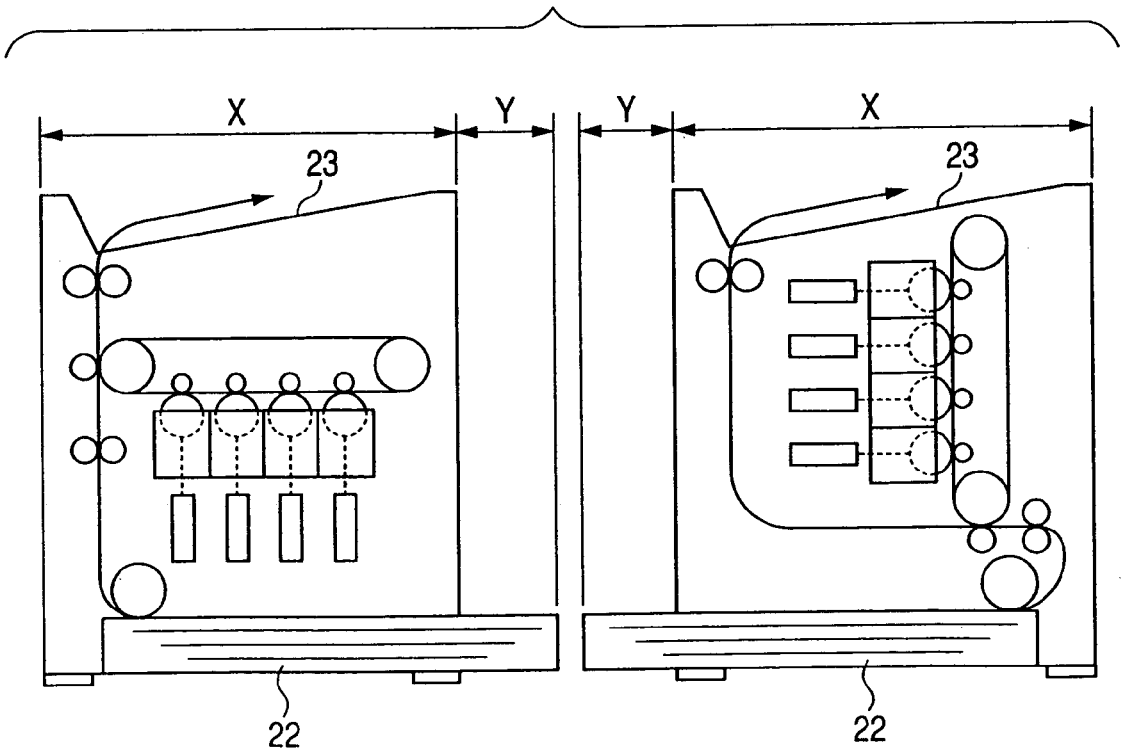
FIG. 7B PRIOR ART

Similar advantages as described above can be achieved when using the arrangement in which a member 5' or 5" that is constituted of the pivoting member and the placement legs in an integrated manner is supported at the center in the width direction by the pivot 5*a* pivotable with respect to the frame 6 of the main body, as shown in FIGS. 4B and 4C.

Alternatively, as shown in FIG. 4A, when, the pivoting member 5 is placed outside the shown hatched region S (between the left and right, third and fourth legs 3 and 4) so that the pivot 5*a* of the pivoting member 5 can be positioned as high as possible, the region whose rigidity must be ensured is limited to the upper portion shown as h, thereby allowing openings to be provided in the region shown by "S" of the frame 6 of the main body, and thus making it easy to incorporate the exposure means, transfer means and electric boards inside the frame 6 of the main body.

Here, since the pivot 5*a* is desirably configured so as to reduce the pivoting resistance as much as possible, it may be a swage pivot, a roller bearing, or a sliding bearing. If the pivoting resistance can be substantially low, a configuration may be used in which the pivoting member 5 simply abuts a vertically angled portion of a metal plate.

The pivot 5*a* is desirably provided at the center of weight of the frame 6 of the main body (the center of gravity) rather than at the center in the lateral direction of the apparatus.

Since the third and fourth placement legs 3 and 4 are desirably configured to reduce the friction resistance in the rectilinear movement, they may be guided by rollers to reduce the friction. If the friction resistance can be substantially lower, a configuration of simple sliding on a surface may be used.

As described above, even when the image forming apparatus is placed on an uneven surface, the distortion of the frame 6 of the main body can be minimized since the action of the pivoting member 5 and the third and fourth placement legs 3 and 4 allows the frame 6 of the main body to be supported at three points: at the first placement leg 1, at the second placement leg 2 and at the pivot 5*a* of the pivoting member 5.

Furthermore, since an unevenness absorbing mechanism is constructed with a simple arrangement of the components, an image forming apparatus can be provided with lower cost, which does not have a problem such as image misregistration or the lowered printing accuracy because mutual positional relationships between elements of the image forming system (photosensitive drum 19, exposure means 15) is not badly affected even when the image forming apparatus is placed on an uneven surface.

Moreover, an image forming apparatus (not shown), in which a unit in an endless belt shape is positioned along the main frame, can minimize the distortion of the frame of the main body even when the body is placed on an uneven surface, producing no displacement force on the endless belt and extending the life of the endless belt.

The above embodiment has been described with respect to an indirect-transfer-type, full-color image forming apparatus that retransfers a toner image formed on the transfer belt onto a recording paper sheet. However, similar advantages can also be obtained in the case of a direct-transfer-type, full-color image forming apparatus that directly transfers a toner image onto a recording paper sheet.

Instead of a color image forming apparatus, a monochromatic image forming apparatus according to the present invention can also reduce the influence of unevenness of placement surface on the parallel accuracy of rollers or the like, thereby advantageously improving printing accuracy.

Although examples of the present invention have been described, the present invention is not limited the above described examples, and rather any modification can be made within the technical concept of the present invention.

This application claims priority from Japanese Patent Application No. 2003-410200 filed on Dec. 9, 2003, which is hereby incorporated by reference herein.

What is claimed is:

1. An image forming apparatus comprising:

a first placement member and a second placement member fixed to a bottom surface of said image forming apparatus for supporting said image forming apparatus while contacting with a placement surface when said image forming apparatus is placed thereon;

a third placement member and a fourth placement member for supporting said image forming apparatus while contacting with the placement surface when said image forming apparatus is placed thereon;

a recording material containing part provided at a side of the bottom surface of said image forming apparatus, for containing recording material;

a shaft provided on a side plate of said image forming apparatus and at position higher than all of said recording material containing part in a vertical direction of said image forming apparatus; and a pivot portion provided on said shaft, wherein said pivot portion pivots around said shaft to move said third placement member and said fourth placement member in a vertical direction of said image forming apparatus.

2. An image forming apparatus according to claim 1, wherein said recording material containing part is provided between said first placement member and said second placement member or between said third placement member and said fourth placement member.

3. An image forming apparatus according to claim 1, wherein said third placement member and said fourth placement member move in association with each other.

4. An image forming apparatus according to claim 1, wherein said third placement member and said fourth placement member are integrally formed with said pivot member.

5. image forming apparatus according to claim 1, wherein said recording material containing part is wider than a width of said image forming apparatus.

6. An image forming apparatus according to claim 1, wherein the side surface of said image forming apparatus on which said supporting member is provided is perpendicular to a direction in which the recording material is conveyed.

7. An image forming apparatus according to claim 6, further comprising toner image forming means which forms a toner image on the recording material and fixing means which fixes the toner on the recording material, wherein said fixing means is provided above said first placement member and said second placement member in the vertical direction of said image forming apparatus.

8. An image forming apparatus according to claim 1, further comprising a frame member including said side plate, wherein said shaft is provided at a centroid portion of said frame member.

* * * * *

UNITED STATES PATENT AND TRADEMARK OFFICE

CERTIFICATE OF CORRECTION

PATENT NO. : 7,315,707 B2
APPLICATION NO. : 11/004914
DATED : January 1, 2008
INVENTOR(S) : Hitoshi Nishitani et al.

It is certified that error appears in the above-identified patent and that said Letters Patent is hereby corrected as shown below:

ON THE TITLE PAGE:

In item "(56) References Cited," under "FOREIGN PATENT DOCUMENTS," the first and second-listed documents,

| | | | |
|---|---|---|---|
| "JP | 10186071 | A * | 7/1998 |
| JP | 10186762 | A * | 7/1998" |

should read as follows:

| | | | |
|---|---|---|---|
| -- JP | 10-186071 | A * | 7/1998 |
| JP | 10-186762 | A * | 7/1998 --. |

COLUMN 1:

Line 42, "backside" should read -- back side --.
Line 44, "above" should read -- above- --.
Line 47, "second transfer" should read -- second-transfer --.

COLUMN 2:

Line 32, "at a time." should read -- at one time. --.

COLUMN 3:

Line 1, "shows" should read -- show --.
Line 19, "legal-size" should read -- legal size --.

COLUMN 5:

Line 12, "the toner" should read -- toner --.
Line 14, "backside" should read -- back side --.
Line 16, "above" should read -- above- --.
Line 30, "backside" should read -- back side --.
Line 39, "denotes" should read -- denote --.

COLUMN 6:

Line 42, "when," should read -- when --.

UNITED STATES PATENT AND TRADEMARK OFFICE

CERTIFICATE OF CORRECTION

PATENT NO. : 7,315,707 B2
APPLICATION NO. : 11/004914
DATED : January 1, 2008
INVENTOR(S) : Hitoshi Nishitani et al.

It is certified that error appears in the above-identified patent and that said Letters Patent is hereby corrected as shown below:

COLUMN 7:

Line 16, "is" should read -- are --.
Line 37, "limited" should read -- limited to --.

Signed and Sealed this

Fifth Day of August, 2008

JON W. DUDAS
*Director of the United States Patent and Trademark Office*